US009345980B2

(12) United States Patent
Lee

(10) Patent No.: US 9,345,980 B2
(45) Date of Patent: May 24, 2016

(54) TOY VEHICLE TRACK SYSTEMS AND CONNECTORS FOR SAME

(71) Applicant: Mattel, Inc., El Segundo, CA (US)

(72) Inventor: Tai To Lee, Kowloon (HK)

(73) Assignee: Mattel, Inc., El Segundo, CA (US)

( * ) Notice: Subject to any disclaimer, the term of this patent is extended or adjusted under 35 U.S.C. 154(b) by 91 days.

(21) Appl. No.: 14/309,424

(22) Filed: Jun. 19, 2014

(65) Prior Publication Data

US 2015/0097046 A1 Apr. 9, 2015

Related U.S. Application Data

(60) Provisional application No. 61/886,212, filed on Oct. 3, 2013.

(51) Int. Cl.
*A63H 19/30* (2006.01)
*A63H 18/02* (2006.01)

(52) U.S. Cl.
CPC ..... *A63H 19/30* (2013.01); *A63H 18/02* (2013.01)

(58) Field of Classification Search
CPC ..... A63H 18/00; A63H 18/02; A63H 18/021; A63H 19/00; A63H 19/30; A63H 19/32; A63H 21/00
USPC ..... 238/10 R–10 F
See application file for complete search history.

(56) References Cited

U.S. PATENT DOCUMENTS

| | | | |
|---|---|---|---|
| 221,817 | A | 11/1879 | Heyn |
| 1,142,150 | A | 6/1915 | Dorrill |
| 1,482,639 | A | 2/1924 | Fergusson |
| 2,021,045 | A | 11/1935 | Boisselier |
| 2,081,682 | A | 5/1937 | Smith |
| 2,290,584 | A | 7/1942 | Gardner |
| 2,428,468 | A | 10/1947 | Pinder |
| 2,534,458 | A | 12/1950 | Larrabee |
| 2,543,460 | A | 2/1951 | Larrabee |
| 2,661,852 | A | 12/1953 | Bonanno |
| 2,690,551 | A | 9/1954 | Pettit |
| 2,862,333 | A | 12/1958 | Gardiol |
| 3,228,607 | A | 1/1966 | Robinette |
| 3,242,610 | A | 3/1966 | Godtfred |
| 3,288,368 | A | 11/1966 | Athearn |
| 3,438,145 | A | 4/1969 | Genin |
| 3,463,393 | A | 8/1969 | Fischer |
| 3,464,624 | A | 9/1969 | Godtfred |
| 3,480,210 | A | 11/1969 | Perrinjaquet |

(Continued)

FOREIGN PATENT DOCUMENTS

| | | | |
|---|---|---|---|
| CA | 2371157 | A1 | 8/2003 |

*Primary Examiner* — R. J. McCarry, Jr.
(74) *Attorney, Agent, or Firm* — Kolisch Hartwell, P.C.

(57) ABSTRACT

A toy vehicle track section connector has a main body with opposing planar first and second surfaces defined by a central portion, first and second outer portions, and first and second end portions joining the central, first and second portions together. Two smaller posts and a third larger post project from the first surface at positions along the longitudinal centerline and on opposite sides of the transverse centerline of the connector. A plurality of ribs project outwardly from the second surface along the first and second outer sections and first and second end portions and form a frame sized to be received in a channel provided on the bottom side of each track section. A hole and cutout are provided at each end of each track section to receive either smaller post and half the larger post, respectively.

20 Claims, 7 Drawing Sheets

(56) References Cited

U.S. PATENT DOCUMENTS

| | | | | |
|---|---|---|---|---|
| 3,487,999 | A | | 1/1970 | Nash |
| 3,581,987 | A | | 6/1971 | Tomaro |
| 3,581,988 | A | | 6/1971 | Kin et al. |
| 3,620,451 | A | | 11/1971 | Richter |
| 3,712,539 | A | | 1/1973 | Staats |
| 3,712,540 | A | | 1/1973 | Yamasaki et al. |
| 3,734,404 | A | | 5/1973 | Baynes et al. |
| 3,735,923 | A | | 5/1973 | Brigham et al. |
| 3,775,897 | A | | 12/1973 | Soulakis et al. |
| 4,054,393 | A | | 10/1977 | Talleri |
| 4,106,695 | A | | 8/1978 | Carella et al. |
| D250,056 | S | | 10/1978 | Heim |
| 4,150,789 | A | | 4/1979 | Tong |
| D261,292 | S | | 10/1981 | Tong |
| 4,397,419 | A | | 8/1983 | Fischer |
| 4,461,116 | A | | 7/1984 | Bach |
| 4,544,094 | A | | 10/1985 | Scholey |
| 4,989,782 | A | | 2/1991 | McKie |
| 4,993,631 | A | | 2/1991 | Niehoff |
| 5,139,198 | A | * | 8/1992 | Niehoff ..... F16B 3/00 238/10 B |
| 5,222,902 | A | | 6/1993 | Piersch |
| 5,579,997 | A | | 12/1996 | Jackson et al. |
| 5,779,145 | A | | 7/1998 | Zelle et al. |
| 5,823,531 | A | | 10/1998 | Huber |
| 5,826,835 | A | | 10/1998 | Wilson et al. |
| 5,928,051 | A | | 7/1999 | Krog |
| 5,993,283 | A | | 11/1999 | Cyrus et al. |
| 6,601,774 | B1 | | 8/2003 | Kasimoff |
| 6,647,893 | B1 | | 11/2003 | Fugitt et al. |
| 6,948,998 | B2 | | 9/2005 | Bagley |
| D588,209 | S | | 3/2009 | Shimizu |
| D630,262 | S | | 1/2011 | Hornsby et al. |
| 7,922,101 | B2 | | 4/2011 | Norman et al. |
| 8,197,297 | B2 | | 6/2012 | Shimizu |
| 2004/0182947 | A1 | | 9/2004 | Wa |
| 2011/0042473 | A1 | | 2/2011 | Hesse |
| 2013/0126628 | A1 | | 5/2013 | DiBartolo et al. |
| 2014/0134915 | A1 | | 5/2014 | Wilson |

* cited by examiner

TOY VEHICLE TRACK SYSTEMS AND CONNECTORS FOR SAME

REFERENCE TO RELATED APPLICATION

This application claims priority from U.S. Patent Application No. 61/886,212, filed Oct. 3, 2013.

BACKGROUND OF THE INVENTION

The present invention relates generally to toy vehicle track systems, and more particularly to track systems for toy vehicle which includes connectors securely joining together adjoining track sections while permitting easier release of the sections from the connector and one another.

Flexible, plastic track or roadway systems for toy vehicles are known in the prior art as exemplified by a patent to Nash et al., U.S. Pat. No. 3,487,999, issued Jan. 6, 1970, to the assignee of the present invention, and has been marketed extensively under the trademark "HOT WHEELS." The track systems disclosed in the above-mentioned patent have functioned exceedingly well for toy vehicles of a relatively small scale; that is, vehicles having a width of about 1 to 1¼ inches while the track section width is about 1½ inches.

A concern for any toy track system is that it be economically manufactured. Since a track system of synthetic resin material provides sufficient durability to withstand abuse and flexibility to allow twisting and curving to enable various track system layouts, it is desirable to develop a track system where as many as possible of the components are fabricated by an extrusion process. Those components which cannot be extruded must, for economic reasons, be easily molded.

Another form of track connector for use with heavier, modified "Hot Wheels" track sections is disclosed in U.S. Pat. No. 3,712,539. It was objects of these track sections and connectors to provide a track system having improved strength and stiffening characteristics and to improve the alignment of abutting track sections for use with larger, heavier toy vehicles. It did so by multiplying the flanges projected from the bottom side of the track sections and providing multiple joined connectors to frictionally engage the multiple flanges. While these modifications achieved their desired objects, they also resulted in the track sections being held more firmly together, making it more difficult for children, especially the youngest children that might use such sets, to break down the connected sections. Moreover, the design of the connectors resulted in a height that elevated the connected ends of the adjoining track sections from the surface supporting the track set, which necessitated the additional depending flanges of the track sections to stiffen them. The combination increased the amount of material needed for each track section and connector as well as complicating their fabrication.

It would be desirable to provide track systems of track sections and connectors that meet the objects of improved alignment and securement of adjoining track sections with easy of manufacture of the components and separation closer to that of the original track system components.

BRIEF SUMMARY OF THE INVENTION

In one aspect the invention is a one-piece, elongated, molded plastic connector configured to join together at least a pair of identical toy vehicle track sections, the connector comprising: an elongated, planar main body with opposing planar first and second major surfaces defined by an elongated central portion having opposed first and second elongated side edges, first and second elongated outer portions spaced laterally outwardly respectively from the first and second elongated side edges, and first and second end portions joining the central portion and the first and second outer sections at opposing elongated ends of the main body, the main body and central portion having a common longitudinal centerline in an elongated direction between the opposing longitudinal ends, and the main body, the central portion and the first and second outer portions having a common transverse centerline perpendicular to the longitudinal centerline; and first and second posts, projecting outwardly from the planar first major surface of the central portion at positions along the longitudinal centerline and on opposite sides of the transverse centerline.

In another aspect, the invention is the aforesaid connector in combination with at least one elongated flexible track section comprising: a first face portion extending a length of the track section so as to support a toy vehicle between opposing longitudinal ends of the track section and oppositely disposed guide flanges extending essentially the length of the track section and projecting obliquely from the first face portion so as to maintain the toy vehicle on the first face portion of the track section; a second face portion opposite the first face portion and at least two flange elements depending from the second face portion, the flange elements each having a substantially L-shaped cross section facing the other flange element, the at least two flange elements being shaped and spaced sufficiently apart from one another sufficiently to define enclosures for the outer portions of the track connector with the track connector positioned the flange elements; and a closed perimeter opening extending entirely through the track section through the first and second face portions proximal either longitudinal end of the track section, each opening being proximal to and spaced inwardly from an end edge of the longitudinal end supporting the opening, each opening being shaped and sized to closely receive either one of the first and second posts of the track connector received between the at least two flange elements.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

DESCRIPTION OF THE INVENTION

Figure 1:
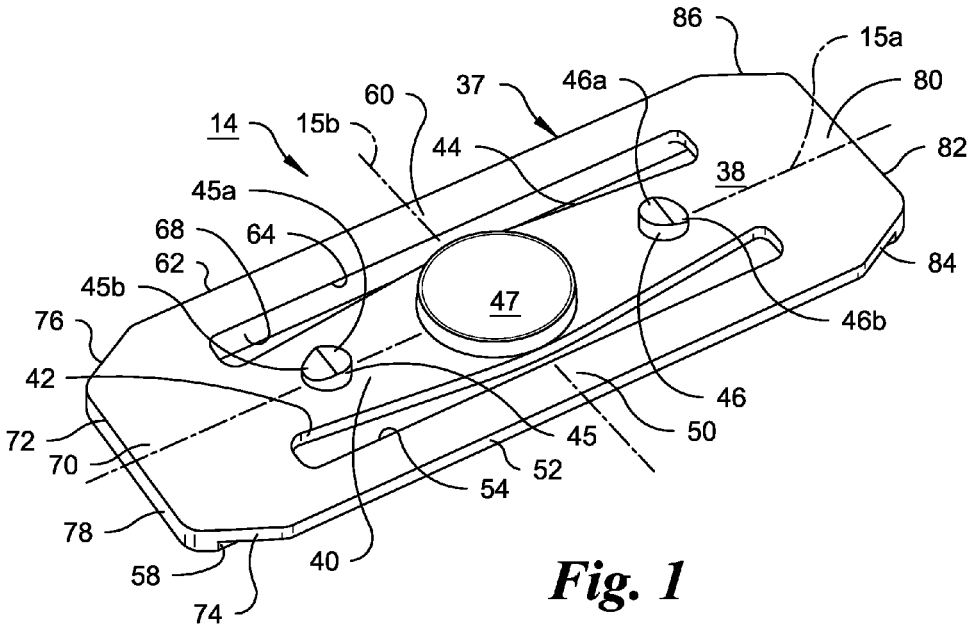
FIGS. 1 and 2 are respective, opposing top and bottom perspective views of a track section of the present invention.
Figure 2:
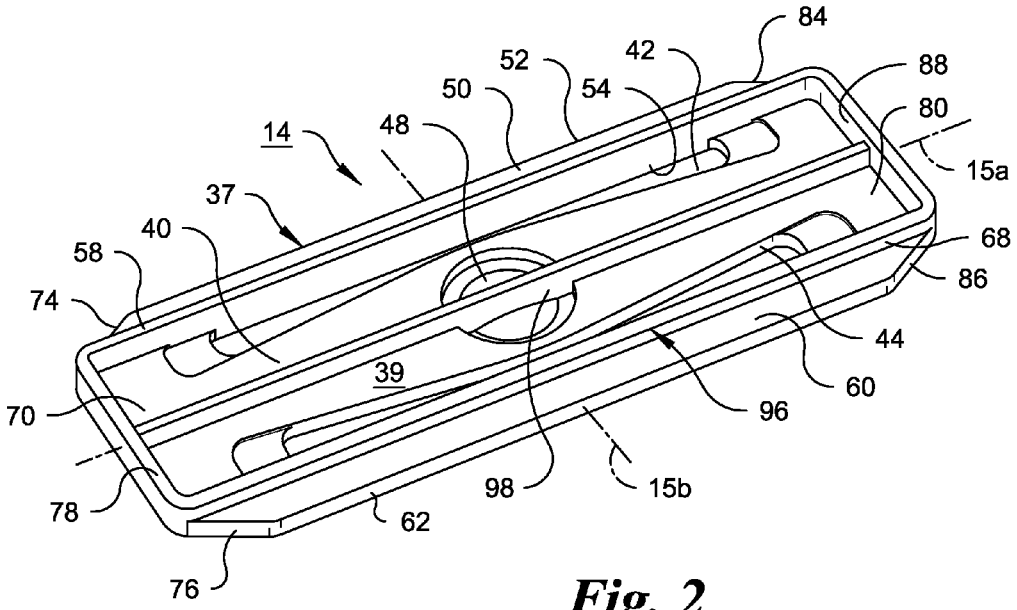
Figure 3:
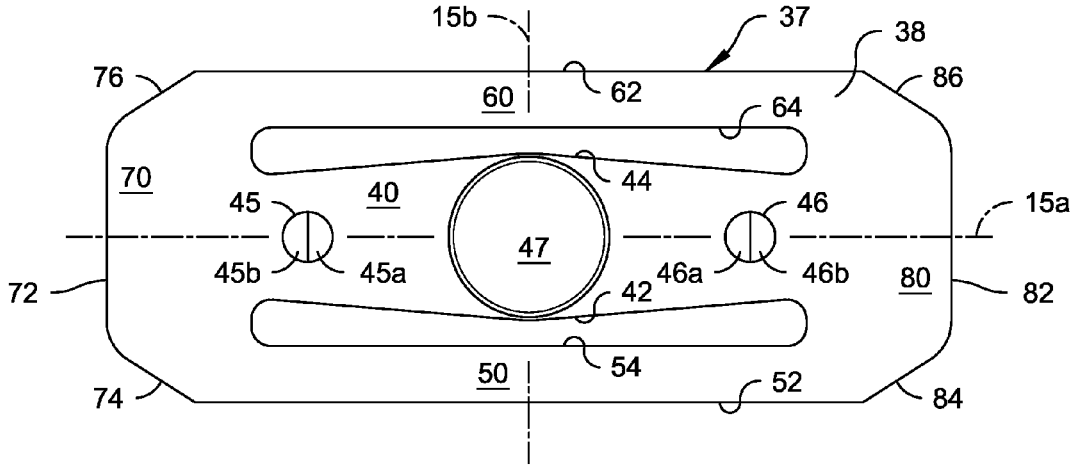
FIGS. 3 and 4 are respective, opposing top and bottom plan views of a track connector of the present invention.
Figure 4:
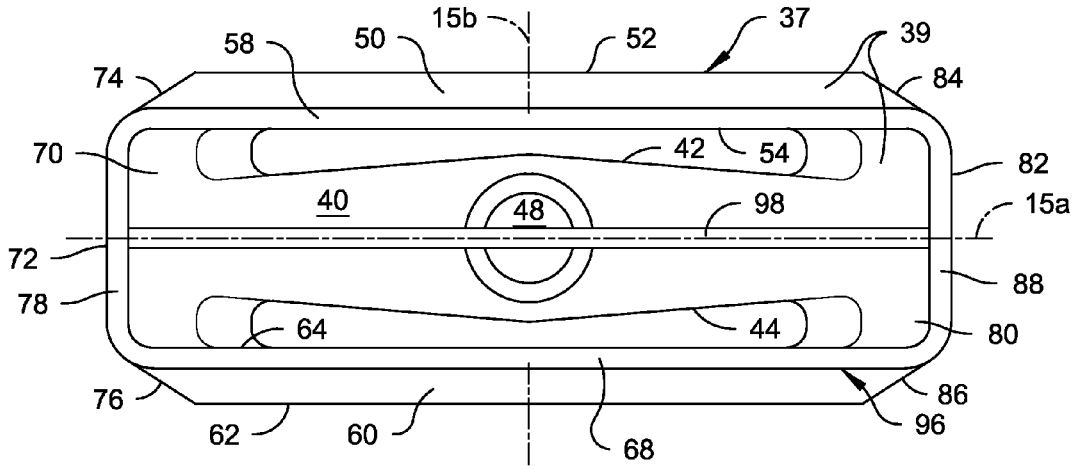
Figure 5:
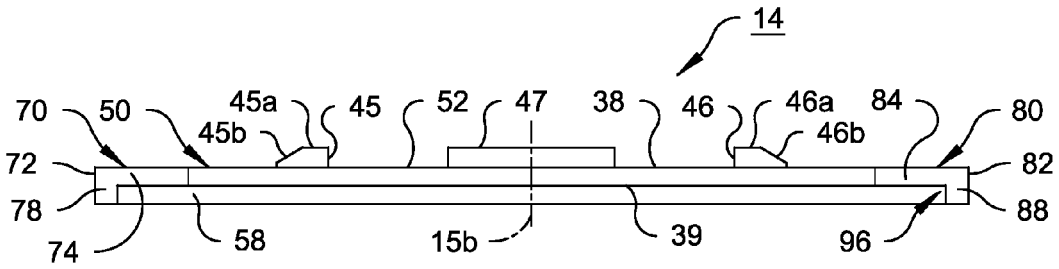
FIGS. 5 and 6 are respective end and side elevation views of the aforesaid track connector.
Figure 6:
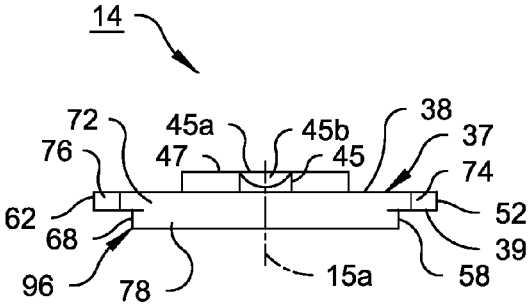

Certain terminology is used in the following description for convenience only and is not limiting. The words "right,"

"left," "lower" and "upper" designate directions in the drawings to which reference is made. The words "inwardly" and "outwardly" refer to directions toward and away from, respectively, the geometric center of the stated component and designated parts thereof. The terminology includes the words above specifically mentioned, derivatives thereof and words of similar import.

Figure 7:
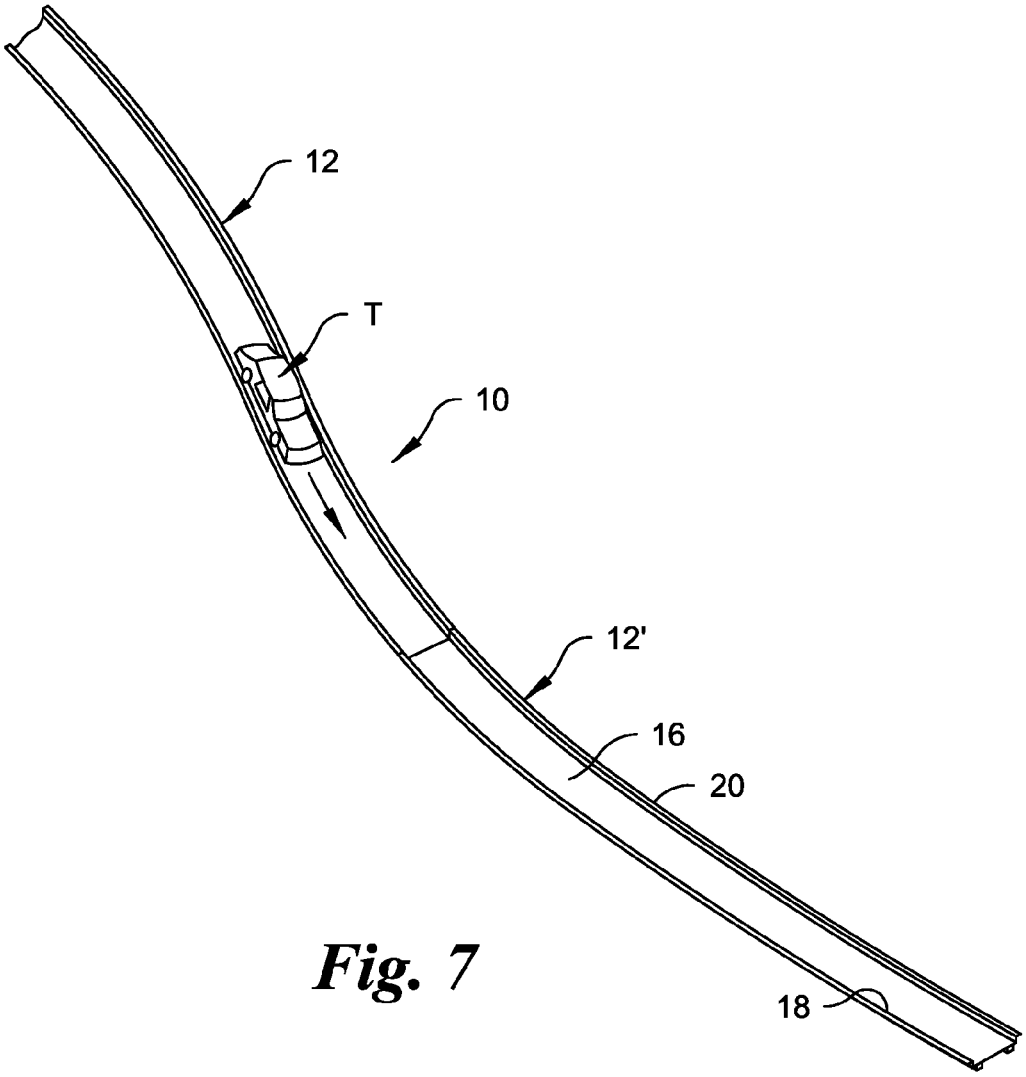
FIG. 7 is a perspective view of a portion of a toy vehicle flexible track system according to the present invention utilizing the connector of FIGS. 1-6.

Referring now to FIG. 7, there is illustrated a toy vehicle flexible track system 10 which includes a two adjoining track sections 12, 12' connected by a track connector 14 of the present invention, hidden from view beneath the sections 12, 12'. As contemplated for its intended use, a number of track sections of various known geometries (straight, curved, branching, etc.) will be connected in a serial fashion with a number of track connectors, one track connector at each abutment of two track sections. The track system may be laid along a flat surface, such as a floor, or it may be attached at some location above a floor, such as a table top, with the remainder of the track sloping downward toward the floor and along the floor. It is also contemplated that various accessories may be included in any track system layout, including specially designed curves jump ramps, loops, lane mergers, and various devices for imparting motion to a toy vehicle.

Referring to the various FIGS. 7-10, a toy vehicle T will generally ride upon a generally planar, first or upper or top face portion 16 of the track sections 12, 12' and will be maintained and guided on the upper face portion by two guide flanges 18 and 20, which are integrally connected to the upper or top face portion 16 and which project obliquely from the face portion 16 of each section 12. Except for openings which will be described, the depicted straight track sections 12, 12' have an essentially uniform cross-section throughout its length so as to be easily extruded. As already mentioned, the upper face portion 16 is the roadway on which the toy vehicle T will move and the guide flanges 18, 20 keep the toy vehicle T confined to the track section 12. It is contemplated that the width of the upper face 16 is greater than the width of the corresponding toy vehicle T so that the toy vehicle may move in response to a lateral component of movement causing the vehicle to come into contact with one or the other of the two guide flanges. A preferred width for just the upper face is about 2 inches, while the overall width of the track section is about 2⅜ inches. By being located in an oblique fashion, a properly designed toy vehicle will have little area contact with the guide flanges so as not to cause an excessive frictional engagement.

Opposite the upper face portion 16 is a second or lower or bottom face portion 22 from which extends two flange elements 24, 26. The flange elements 24, 26 extend parallel to a longitudinal centerline 13*a* of the track section 12 and strengthen and stiffen the track section. The flange element 24, 26 form a channel indicated at 28 which defines a receptacle for the receipt of the track connector 14. Each of the flange elements 24, 26 has a generally L-shaped cross section and the flange elements 24, 26 form with the lower face 22, facing C-shaped enclosures at the side edges of the channel 28 such as the enclosure 30 formed by the flange element 24 and an opposite portion of the lower face 22 and enclosure 32 formed by the flange element 26 and an opposite portion of the lower face 22.

The track section 12 described thus far is well known. According to the invention, a closed perimeter opening or "hole" 34 and an open perimeter cutout 36 are provided extending entirely through the track section 12, through the upper and lower face portions 16, 22, at each longitudinal, connectable end of the track section 12. In the case of the depicted straight track section 12, hole 34 is provided proximal to and cutout 36 is provided in each longitudinal end edge 35 of the section 12, centered between the guide flanges 18, 20 and flange elements 24, 26. The holes 35 and cutouts 36 are symmetric with respect to the longitudinal centerline 13*a* and a transverse centerline 13*b* of the track section 12. The hole 34 is circular and cutout 36 is semicircular for convenience but each could be of different shapes. As straight track sections 12 are typically cut from longer, continuous extensions (i.e. extrusions), the holes and cutouts can be cut at the same time by the same cutting operation, if desired.

Referring now to various FIGS. 1-6, to achieve an improved alignment between abutting track sections 12, 12' for stiffening the track section end portions and for providing an improved frictional engagement, the track connector 14 includes an elongated, planar main body 37 with opposing, planar, upper/first and lower/second major surfaces 38, 39. The planar main body 37 is generally rectangular with four angled corner edges 74, 76, 84, 86, each being transverse to both a longitudinal centerline 15*a* of the connector 14 and a transverse centerline 15*b* perpendicular to longitudinal centerline 15*a* of the connector 14.

The planar main body 37 is defined by coplanar elongated central portion 40 with first and second elongated side edges 42, 44, first and second elongated outer portions 50, 60 spaced laterally outwardly respectively from the first and second side edges 42, 44, and first and second end portions 70, 80 joining the central portion 40 and the first and second outer portions 50, 60 at, and defining opposing elongated ends of the main body 37 and the connector 14. The end portions 70, 80 have respective distal edges 72, 82, between angled edges 74, 76 and 84, 86, respectively.

The main body 37, central portion 40 and end portions 70, 80 have a common longitudinal centerline 15*a* in the elongated direction. The main body 37 and the central and first and second outer portions 40, 50, 60 all have a common transverse centerline 15*b* perpendicular to the longitudinal centerline 15*a*. The centerlines 15*a*, 15*b* are parallel to the plane of the main body 37 and thus each of its planar major sides 38, 39 and each of the portions 40, 50, 60, 70, 80.

First and second posts 45, 46 project outwardly from the planar first major surface 38 of the central portion 40 at positions along the longitudinal centerline 15*a* and symmetric with respect to the transverse centerline 15*b*, and are mirror images of one another with respect to the transverse centerline 15*b*. Each of the first and second posts preferably has a circular cross section at the planar first major surface 38 and a respective top surface 45*a*, 46*a*, most distal to the planar first major surface 38, with a bevel 45*b*, 46*b* extending downward from approximately midpoints of the top surfaces 45*a*, 46*a* towards the end portion 70, 80, respectively, most proximal to the post 45, 46. Each post maintains a short, semicircular surface below the bevel to engage with the track section 12 it is connecting.

A third post 47 projects outwardly from the planar first major surface 38 between the first and second posts 45, 46, centered with respect to the longitudinal and transverse centerlines 15*a*, 15*b*. The third post has a cross section at the first major surface 38 larger in area than the circular cross section of each of the first and second posts 45, 46. Preferably, the cross section of the third post 47 at the first major surface 38 is circular although it could have other shapes. Preferably also, the third post 47 is hollow and defines a circular recess 48 in the planar second major surface 39.

The connector 14 further includes a plurality of elongated ribs 58, 68, 78, 88 projecting outwardly from the planar second major surface 39 along the first and second outer sections 50, 60 and along the first and second end portions 70, 80, respectively. Two longer ribs 58, 68 project from the planar second major side 39 along inner side edges 54, 64 of the first and second outer portions 50, 60 facing the elongated side edges 42, 44, respectively, of the central portion 40. Ribs 58, 68 are parallel to one another and equal in length. Two shorter ribs 78, 88 extend from end portions 70, 80 parallel to the transverse centerline 15*b* and between adjoining ends of the two longer ribs 58, 68 such that the two longer ribs and the two shorter ribs are connected end to end to form an integral hollow rib frame 96 with a continuous, unbroken, closed circumference. A fifth rib 98 is also preferably provided extending from the end portions 70, 80 and the central portion 40 along the longitudinal centerline 15*a* between the two shorter ribs 78, 88 for additional stiffening. Fifth rib 98 spans the recess 48 of the third post 47 and extends the full depth of the recess 48.

Protrusions 56, 66 are located on inner edges 54, 64 of the outer portions 50, 60 at the transverse centerline 15*b* and face side edges 42, 44, respectively, of central portion 40 where the edges 42, 44 are flared outwardly to accommodate the third post 47 with the maximum extend of flaring being along the transverse centerline 15*b*.

Figure 8:
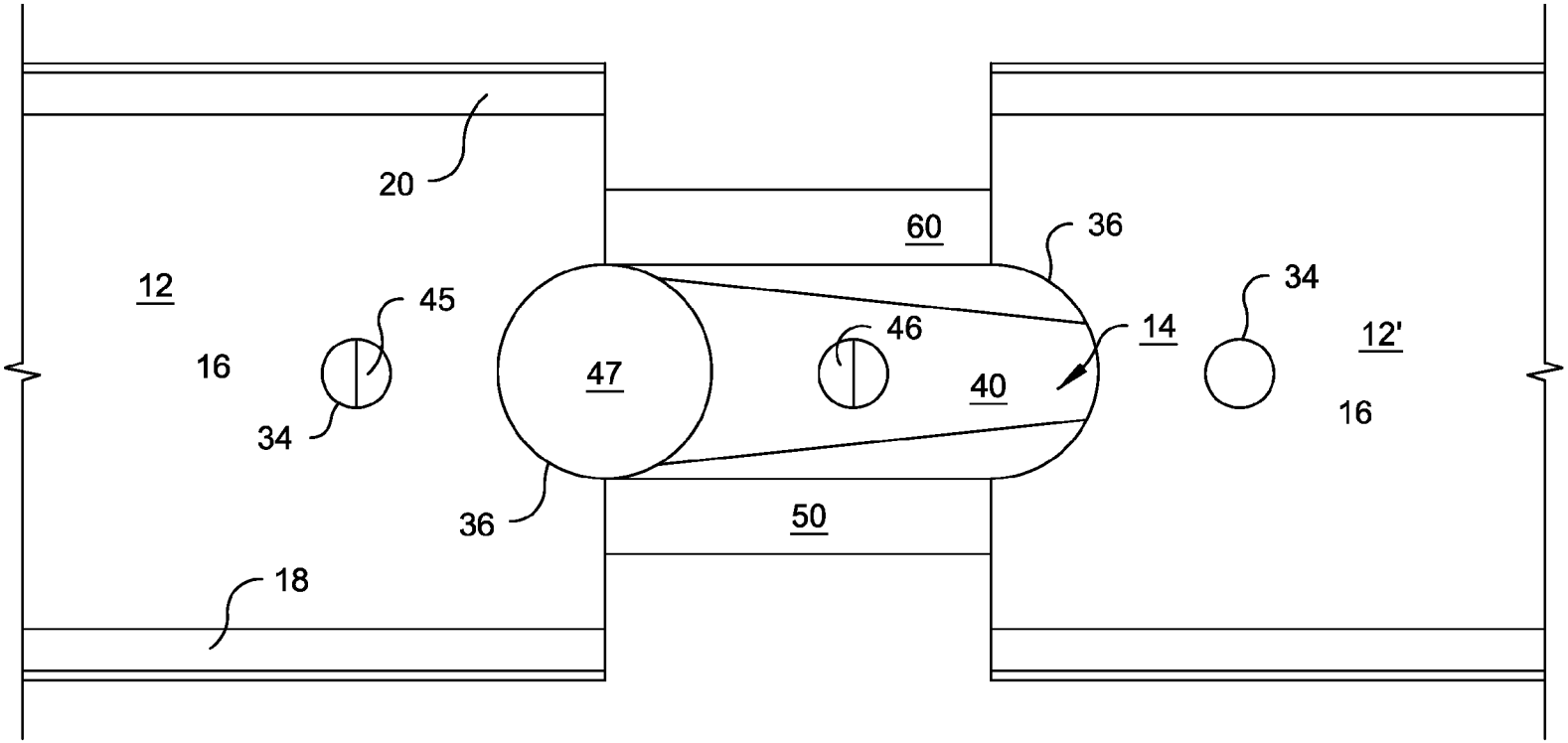
FIGS. 8 and 9 are respective top and bottom plan views of the aforesaid track connector joined with one track section of the present invention.
Figure 10:
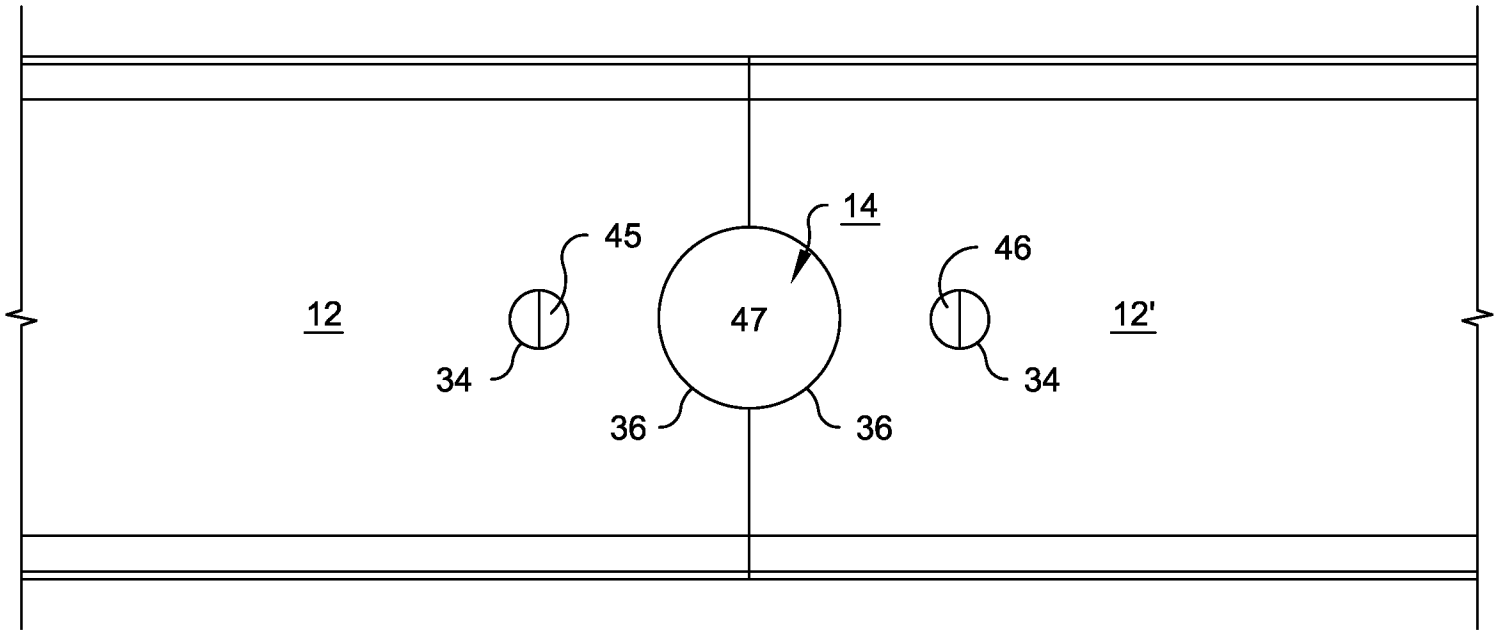
FIG. 10 is a top perspective view of two of the aforesaid track sections joined by the aforesaid track connector.

Referring to FIGS. 8 and 10, each of the first and second posts 45, 46 is essentially identical in size and shape to each hole 34 proximal each longitudinal end of each track section 12. Each half of the third post 47, on either side of the transverse centerline 15*b*, is essentially identical in size and shape to the cutout 36 at each longitudinal end of each track section 12, 12' so that the posts 45, 46 can be received in holes 34 and the third post 47 received in a circular opening defined by the two semicircular cutouts 36 at adjoining ends of two of the track sections 12, 12'. The fit between posts 45, 46 and holes 34 is preferably selected for a desired positive degree of frictional engagement. There need not be comparable or any frictional engagement between the third post 47 and the adjoining cutouts 36 but it should be appreciated that the closer the fit between the third post 47 and each cutout 36, combined with the fit between either post 45, 46 and the hole adjoining the cutout, the more rigidly the track section 12, 12' is held in parallel alignment with the connector 14 and with the end of any other track section held by the remaining end of the connector. To that end, the minimum distance between each post 45, 46 and the third post 47 can be selected to be slightly less than the minimum distance between the hole 34 and cutout 36 at each longitudinal end of the track section so that the portion of the track section 12 hole 34 and cutout 36 can be held in a degree of compression between the third post 47 and one of the other posts 45, 46, if desired.

Figure 9:
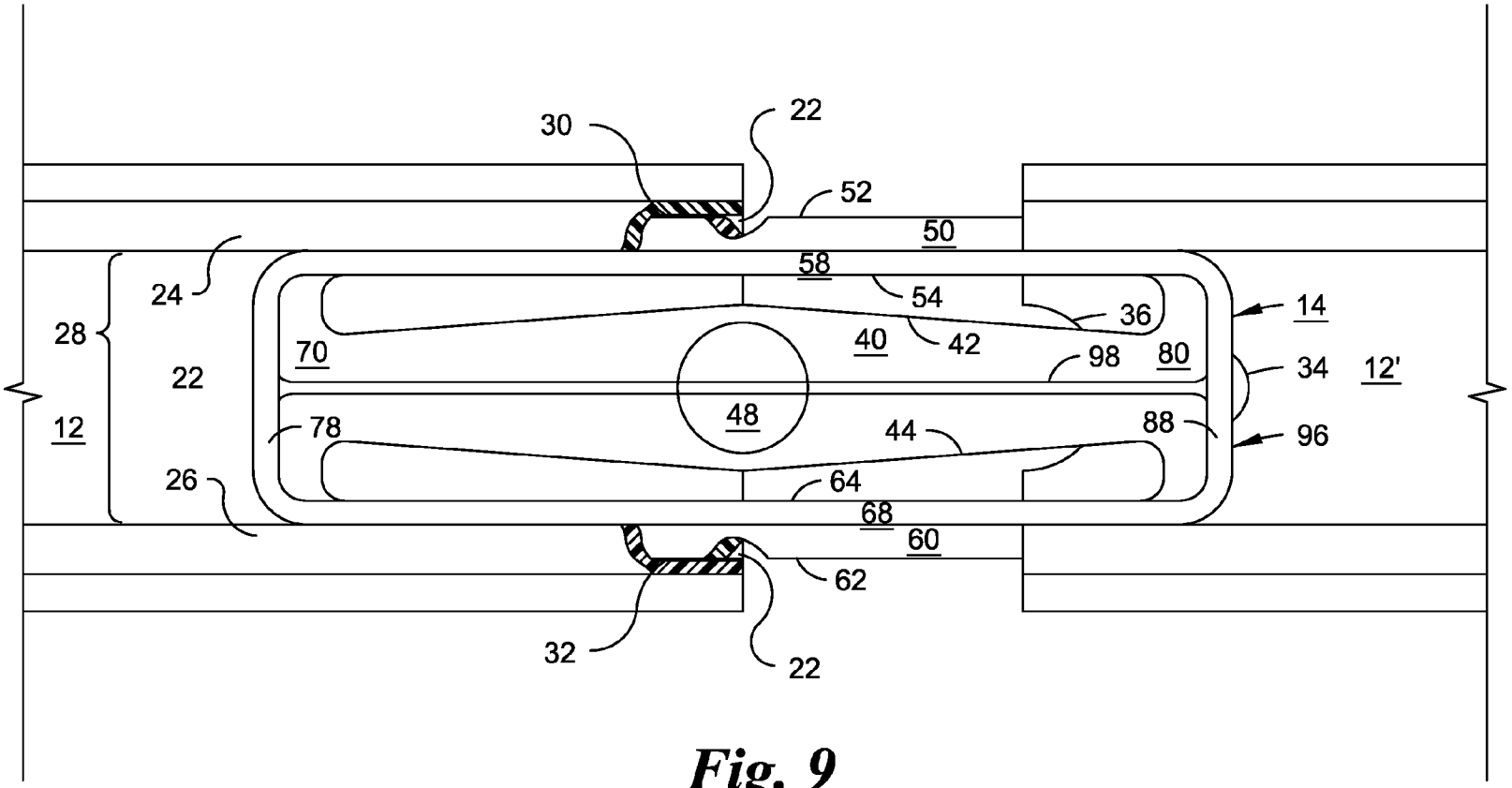

Referring to FIG. 9, it can be seen that the two longer ribs 68, 78 are spaced apart a distance substantially equal to the spacing between the inner edges of the inwardly turned distal portions of each of the flange elements 24, 26 so that the rib frame 96 slides between and fits closely with those inner edges while the remainder of the outer portions 50, 60 outward of the ribs 58, 68 are received in the respective enclosures 30, 32. The connectors 14 and track sections 12 are sufficiently flexible so that an end portion 70 or 80 of the connector 14 can be inserted into a longitudinal end of a track section 12, with the angled corner edges 74, 76 or 84, 86 helping to align the ends, and the connector 14 slid into the bottom channel 28 with the outer portions 50, 60 sliding into the enclosures 30, 32 until the post 45 or 46 engages with the proximal hole 34. The depth of the ribs 58, 68, 78, 88 is preferably no greater than the thickness of the inwardly turned distal portions of the flange elements 24, 26 so that the bottommost surfaces of the flange elements 24, 26 and the ribs 58, 68, 78, 88 are essentially flush. Also, the separation of the outer sides of the longer ribs 58, 68 is nearly equal to the separation of the innermost distal edges of the flange elements 24, 26 so that the rib frame 96 maintains the longitudinal centerline 13*a* of the engaged track section 12 parallel to that 15*a* of the connector 14 and thus to that 13*a* of the second track section 12' attached to the connector. Again, each of these various parts of the track sections 12 and connectors 14 can be dimensioned for the materials used to provide a desired amount of frictional force and engagement between the mating elements.

Separation of a pair of joined track sections 12, 12' is assisted by the provision of the third post 47. Referring to FIG. 10, the top surface 47*a* of the third post 47 is sufficiently large so as to be able to receive the end of a child's thumb, which can be used to push inwardly/downwardly on the top of the third post 47 while holding and bending the two joined track sections 12, 12' away from the upper major surface 38 of the connector 14, until the holes 34 separate from the first and second posts 45, 46. This separation is aided by the provision of the bevels 45*b*, 46*b*, to the top surface 45*a*, 46*a*, of each post 45, 46, which minimize the distance the inward edge of each hole 34 has to side in contact with the circular outer surface of each post 45, 46.

It should be readily apparent that with the present track system there is interference engagement between the new track connector 14 and joined track sections 12, 12', as well as frictional engagement, to more securely hold together and maintain in alignment the joined track sections 12, 12'. Further because of the provision of the rib frame, the connected track sections 12, 12' are aligned more truly and that alignment maintained during use. The new sets remain relatively easy and less expensive to manufacture than other improvement options tried before.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the scope of the presently disclosed invention.

The invention claimed is:

1. A one-piece, elongated, molded plastic connector configured to join together at least a pair of identical toy vehicle track sections, the connector comprising:

an elongated, planar main body with opposing planar first and second major surfaces defined by an elongated central portion having opposed first and second elongated side edges;

a first elongated outer portion spaced from the first elongated side edge to define a first elongate hole therebetween;

a second elongated outer portion spaced from the second elongated side edge to define a second elongate hole therebetween;

first and second end portions joining the central portion and the first and second outer portions at opposing ends of the main body, the main body and central portion having a common longitudinal centerline in an elongated direction between the opposing ends, and the main body, the central portion and the first and second outer portions having a common transverse centerline perpendicular to the longitudinal centerline; and first and second posts projecting outwardly from the planar first major surface of the central portion at positions along the longitudinal centerline and on opposite sides of the transverse centerline.

2. The connector of claim 1 wherein the first and second posts are mirror images of one another with respect to the transverse centerline.

3. The connector of claim 2 wherein each of the first and second posts has a circular cross section at the planar first major surface and a top surface most distal to the first major surface with a bevel extending downward towards the end portion most proximal to the post.

4. The connector of claim 2 further comprising a third post projecting outwardly from the planar first major surface between the first and second posts, the third post being centered with respect to the longitudinal and transverse centerlines, the third post having a cross section at the planar first major surface larger in area than the circular cross sectional area of each of the first and second posts at the planar first major surface.

5. The connector of claim 4 wherein the third post has a circular cross section at the planar first major surface.

6. A one-piece, elongated, molded plastic connector configured to join together at least a pair of identical toy vehicle track sections, the connector comprising:

an elongated, planar main body with opposing planar first and second major surfaces defined by an elongated central portion having opposed first and second elongated side edges;

first and second elongated outer portions spaced laterally outwardly from the first and second elongated side edges, respectively;

first and second end portions joining the central portion and the first and second outer portions at opposing ends of the main body, the main body and central portion having a common longitudinal centerline in an elongated direction between the opposing ends, and the main body, the central portion and the first and second outer portions having a common transverse centerline perpendicular to the longitudinal centerline;

first and second posts projecting outwardly from the planar first major surface of the central portion at positions along the longitudinal centerline and on opposite sides of the transverse centerline; and a plurality of elongated ribs projecting outwardly from the planar second major side along the first and second outer portions and along the first and second end portions.

7. The connector of claim 6 wherein the plurality of elongated ribs include two longitudinal ribs projecting from the second major side along inner side edges of the first and second outer portions facing the elongated side edges of the central portion.

8. The connector of claim 7 wherein the plurality of ribs include two transverse ribs extending from the first and second end portions in elongated directions parallel to the transverse centerline.

9. The connector of claim 7 wherein the plurality of ribs include two transverse ribs extending between adjoining ends of the two longitudinal ribs such that the two longitudinal ribs and the two transverse ribs are connected end to end to form a hollow rib frame having a continuous, unbroken, closed circumference.

10. The connector of claim 9 wherein the plurality of ribs includes a fifth rib extending from the planar second major surface along the longitudinal centerline between the two transverse ribs.

11. In combination a one-piece, elongated, molded plastic connector configured to join together at least a pair of identical toy vehicle track sections, and at least one elongated flexible track section, wherein the connector comprises:

an elongated, planar main body with opposing planar first and second major surfaces defined by an elongated central portion having opposed first and second elongated side edges, first and second elongated outer portions spaced laterally outwardly from the first and second elongated side edges, respectively, first and second end portions joining the central portion and the first and second outer portions at opposing ends of the main body, the main body and central portion having a common longitudinal centerline in an elongated direction between the opposing ends, and the main body, the central portion and the first and second outer portions having a common transverse centerline perpendicular to the longitudinal centerline, and first and second posts projecting outwardly from the planar first major surface of the central portion at positions along the longitudinal centerline and on opposite sides of the transverse centerline; and wherein the track section comprises:

a first face portion extending a length of the track section so as to support a toy vehicle between opposing longitudinal ends of the track section and oppositely disposed guide flanges extending essentially the length of the track section and projecting obliquely from the first face portion so as to maintain the toy vehicle on the first face portion of the track section, a second face portion opposite the first face portion and at least two flange elements depending from the second face portion, the flange elements each having a substantially L-shaped cross section facing the other flange element, the at least two flange elements being shaped and spaced sufficiently apart from one another sufficiently to define enclosures for the outer portions of the track connector with the track connector positioned the flange elements, and a closed perimeter opening extending entirely through the track section through the first and second face portions proximal either longitudinal end of the track section, each opening being proximal to and spaced inwardly from an end edge of the longitudinal end supporting the opening, each opening being shaped and sized to closely receive either one of the first and second posts of the track connector received between the at least two flange elements.

12. The connector and elongated track section combination of claim 11 wherein the connector includes a third post projecting outwardly from the planar first major surface between the first and second posts, the third post being centered with respect to the longitudinal and transverse centerlines of the connector, the third post having a cross section at the planar first major surface larger in area than a cross sectional area of either of the first and second posts at the planar first major surface; and wherein the track section further includes a cutout in the end edge of at least one longitudinal ends of the track section, the cutout extending entirely through the track section through the first and second face portions and being located proximal the closed perimeter opening supported by the one longitudinal end, the cutout being shaped and sized to closely receive one half of the third post of the track connector with the proximal closed perimeter opening receiving one of the first and second posts.

13. The connector and elongated track section combination of claim 11 wherein the connector includes a first pair of ribs extending from the planar second major surface along the outer portions of the connector, the first pair of ribs being spaced apart a lateral distance essentially equal to lateral spacing between innermost edges of inwardly turned distal portions of each of the flange elements so that the first pair of ribs along the outer portions fit closely between the innermost edges of the flange elements while remainders of the outer portions outward of the ribs are received in the respective enclosures.

14. The connector and elongated track section combination of claim 13 wherein each of the pair of ribs has a depth extending from the planar second major surface no greater than a thickness of the inwardly turned distal portions of the flange elements so that bottommost surfaces of pair of ribs are essentially flush with or higher than bottommost surfaces of the flange elements.

15. The connector and elongated track section combination of claim 13 wherein the connector includes a second pair of ribs extending from the planar second major surface along the end portions of the connector, the second pair of ribs extending between adjoining ends of the first pair of ribs such that first and second pairs of ribs are connected end to end to form a hollow rib frame having a continuous, unbroken, closed circumference.

16. The connector and elongated track section combination of claim 15 wherein the connector includes a fifth rib extending from the planar second major surface second pair of ribs and along the longitudinal centerline of the connector.

17. The connector and elongated track section combination of claim 13 wherein the track section has a longitudinal centerline extending from the edge of one longitudinal end of the track section to the edge of the opposing longitudinal end of the track section and wherein the flange elements extend between the elongated ends of the track section symmetrically spaced apart from the longitudinal centerline of the track section.

18. The connector and elongated track section combination of claim 17 wherein the entire track section is symmetric with respect to the track section longitudinal centerline.

19. The connector and elongated track section combination of claim 17 wherein the track section has a transverse centerline perpendicular to the track section longitudinal centerline and the track section is symmetric with respect to the transverse centerline.

20. The connector and elongated track section combination of claim 17 wherein the track section has, apart from any holes and cut outs, an essentially uniform transverse cross-section perpendicular to all points along its longitudinal centerline.

* * * * *